US005685786A

United States Patent [19]

Dudley

[11] Patent Number: 5,685,786

[45] Date of Patent: Nov. 11, 1997

[54] PASSIVE GOLF INFORMATION SYSTEM AND METHOD

[75] Inventor: Douglas P. Dudley, West Bloomfield, Mich.

[73] Assignee: Yardmark, Inc., W. Bloomfield, Mich.

[21] Appl. No.: 449,805

[22] Filed: May 24, 1995

Related U.S. Application Data

[63] Continuation-in-part of Ser. No. 240,983, May 11, 1994.

[51] Int. Cl.[6] ..... A63B 57/00; A63B 67/02; G08G 9/00; G06F 15/28

[52] U.S. Cl. ..... 473/407; 473/409; 473/131; 340/323 R

[58] Field of Search ..... 473/150, 169, 473/407, 409; 364/410, 444, 448–449, 458, 460; 340/323 R, 933, 988–991; 280/DIG. 5, DIG. 6; 180/167

[56] References Cited

U.S. PATENT DOCUMENTS

| | | | |
|---|---|---|---|
| 3,786,411 | 1/1974 | Kurachi et al. . | |
| 3,868,692 | 2/1975 | Woodward et al. . | |
| 4,303,243 | 12/1981 | Wolfe . | |
| 4,419,655 | 12/1983 | May . | |
| 4,656,476 | 4/1987 | Tavtigian . | |
| 4,698,781 | 10/1987 | Cockerell, Jr. . | |
| 4,703,444 | 10/1987 | Storms, Jr. et al. . | |
| 4,819,174 | 4/1989 | Furuno et al. . | |
| 4,863,123 | 9/1989 | Bernard et al. . | |
| 5,044,634 | 9/1991 | Dudley | 473/407 |
| 5,056,106 | 10/1991 | Wang et al. . | |
| 5,086,390 | 2/1992 | Matthews . | |
| 5,319,548 | 6/1994 | Germain . | |
| 5,324,028 | 6/1994 | Luna . | |
| 5,326,095 | 7/1994 | Dudley | 473/407 |
| 5,364,093 | 11/1994 | Huston . | |
| 5,434,789 | 7/1995 | Fraker et al. | 473/407 |
| 5,469,175 | 11/1995 | Boman | 473/407 |
| 5,507,485 | 4/1996 | Fisher | 473/407 |

FOREIGN PATENT DOCUMENTS

| | | |
|---|---|---|
| 3501033A | 7/1986 | Germany . |
| 2178210 | 2/1987 | United Kingdom . |

OTHER PUBLICATIONS

*How to Select GPS Receivers,* West Marine 1994 Master Catalog (pp. 6, 7, 8, 12, 19).

*Primary Examiner*—Jessica Harrison
*Assistant Examiner*—Mark A. Sager
*Attorney, Agent, or Firm*—Harness, Dickey & Pierce, PLC

[57] ABSTRACT

A golf information system and method which provides yardage and other information to a golfer relative to landmarks on a golf course operating in a "hands-free" or passive manner. In one embodiment, a differential global positioning satellite receiver (DGPS) is utilized to calculate a golf cart position and each time the cart stops, the detected position is compared with positions of landmarks mapped to zones on holes of the course. A location of each landmark is predetermined and stored in a look-up table, afterwhich the golf cart position is compared with the pre-stored positions to obtain a distance between the golf cart and each landmark. The calculated distance is subsequently outputted, preferably on a visual display where it is observed by a golfer. The system can also be used to send speed-of-play messages to a golfer from a clubhouse in order to speed up play, and can also be used to send emergency signals, and advertisements to the golfer. Information outputted to the golfer can be obtained from on-board memory, or in systems with communication features, the information can be sent from a golf course clubhouse or other remote location.

12 Claims, 3 Drawing Sheets

PASSIVE GOLF INFORMATION SYSTEM AND METHOD

CROSS-REFERENCE TO RELATED APPLICATION

This application is a continuation-in-part of co-pending application Ser. No. 08/240,983, filed May 11, 1994.

BACKGROUND OF THE INVENTION

This invention relates to systems and methods for providing position and other information to a golfer playing a golf course and for further providing golfer play information to a golf course operator.

The game of golf has endured through the years as a test of man's subtle coordination. Powerful men must restrain their strength in favor of timing, touch, and strategy. Variations in a golfer's swing, body alignment, grip, and tempo combine with wind, weather, trees, hills, sand and water to make it virtually impossible to even once play a perfect game.

Professional golfers know the importance of eliminating as many variables from the game as possible in order to improve their scores. They use precision weighted clubs and new balls without scars or ovality. They practice their club swing for hours striving to create a consistent or "grooved" swing. When professional golfers reach a tournament course, they carefully study the tees, greens and hazards to plan their game strategy. One of the key aspects of strategy is knowing the distance or "yardage" from various points on the course to the green, and yardages to various hazards, such as water or sand traps. The yardage information enables the golfer to plan ball placement strategy and select the proper clubs for given distances. The amateur golfer is typically overwhelmed with the complexities of golf, and can rarely afford the luxury of inspecting the course and carefully planning golf strategy. The amateur cannot spend the time necessary to evaluate their ball positions accurately since play would become extremely slow and many courses do not have even the most rudimentary yardage references, such as the markers often used to designate a position 150 yards from the center of the green.

Various mechanized approaches toward determining the yardage to various points or hazards are presently known. Examples of such systems include optical range finders which are trained on a target such as the pin flag and calculate the exact distance through triangulation. Other approaches using radio frequency communication technology are also known for measuring distance to a target. However, typically such devices are "active" devices in that they require a golfer to take some special steps each time yardage information is needed which would slow down play, and would likely be viewed as unfair and awkward to other players. Moreover, such devices do not find distances to other significant course landmarks such as sand traps or water hazards, or features hidden from view. Therefore, an improved device is needed for obtaining positional signals indicating the golfers position which are compared with stored positions of landmarks on a course through calculation, yardage information is outputted to the golfer.

Additionally, the game of golf has evolved through the years from a game where players covered a course on foot while either carrying their clubs or towing their clubs on a hand held cart to a game where most players at least in the United States ride golf carts from shot to shot and hole to hole. As popularity of the game has increased and the number of players riding golf carts has likewise increased, the speed of play has dramatically decreased, particularly due to use of golf carts. However, the speed of play can still be increased. With each stop, a player must mount and demount from the cart which increases the time of play. Furthermore, players are typically paired together on a cart which means the cart must transit back and forth between both player's shots which greatly increases the distance an individual cart must travel. As a result, it has become necessary to monitor the position of golf carts on a course and furthermore to utilize employees, called "rangers", who scout a course for golf carts which are slowing down play in order to intercept them and encourage the players to accelerate their rate of play. However, use of rangers is expensive, inefficient, and disruptive. An employee can only monitor one position on a golf course at a time, and the presence of too many employees can produce an unwelcome golfing environment for most players. Furthermore, slow play on golf courses is generally caused by a handful of players who slow down play for the players following behind them. By monitoring the speed of play of all golf carts on a course, the information can be used to target slow golf carts in order to accelerate their play. As a result, a golf course can be more efficiently utilized which increases income on the course and makes play for all players more pleasurable and efficient.

Various approaches have been taken to monitor a position on a golf course, including radio frequency transmitters and receivers which function to perform radio location of a vehicle with respect to a plurality of transmitter antennas. Alternatively, location transmitters have been provided adjacent corresponding golf holes in a golf course which transmit a location signal to a golf-cart-based receiver in order to determine the length of time a golfer is taking to play a particular hole. However, such systems do not accurately determine position of a golf cart on a course while it is being played over its entire surface, and furthermore can not provide position and bearing information to a golfer in conjunction with speed of play information. Furthermore, improvements are needed for bi-directional exchange of such information between a golf cart and a clubhouse for interactively monitoring speed of play and transmitting warnings and messages between a player and a clubhouse, and additionally for detecting emergency conditions on a course. Additionally, previous attempts at monitoring golf cart position on a course have failed to accurately detect the golf cart's position relative to a hole being played, for example, when a ball is inaccurately played and it strays into another hole's playing area it causes confusion for the monitoring system when it can not distinguish which present hole is being played by a golfer.

Previously known golfer information systems typically require that the golfer actively request specific yardage and other information. Examples include the punching of a keypad to indicate the hole being played and the making of a specific golf yardage request to a particular target. Such approaches have the disadvantage that, as opposed to speeding the play of a golf game, they act as an interference and another activity which must be engaged in during the playing of a golf round. Moreover, the rules of tournament golf may not permit such "active" systems in that they may be perceived as providing a golfer with superior knowledge of such an interactive system an advantage not related to golfer skill. Since there is no specific request entered for the information in a passive system, any golfers playing the same hole and being located at the same positions is given identical information and thus all golfers enjoy the same advantages through use of the system. Accordingly, there is a need to provide a passive or "hands-free" golf information system which provides and constantly updates information provided to a golfer during a round of golf.

Therefore, a need has arisen for a system which provides general golf information in a hands-free or passive manner and further provides positional and locational information to a golfer on a course and which would improve speed of play. An ideal system would further provide monitoring and signaling between a golf cart and a golf clubhouse which automatically monitors a golfer's speed of play and notifies the golf course personnel and golfer of slow play, while further being capable of providing for additional information of interest to a golfer.

Further objects, features and advantages of the invention will become apparent from a consideration of the following description and the appended claims when taken in connection with the accompanying drawings.

SUMMARY OF THE INVENTION

The systems and methods according to the present invention provide the desirable features discussed previously. In accordance with this invention a golf cart or handheld information unit that moves with the golfer first receives one or more signals which are processed to designate its location. One example of a means of establishing its location is through the use of a global positioning satellite (GPS) system. Through the use of recent advances in GPS technology, the GPS satellite location signal is supplemented with a ground base radio navigation differential beacon which greatly enhances the accuracy with which a position can be fixed. Once the golfer information system receives a position signal it compares its present location with significant landmark position data stored in memory and calculates a difference in position to generate a distance value. Various types of golfer information can be provided using this approach. For example, a distance to a green or cup can be displayed with accuracy. Similarly, distance to water hazards or sand traps can also be displayed. Since many golfers desire to know the distance of their drive, this information can also be displayed. In addition to yardage and position information, other information of significance to a golfer can be generated. For example, local weather information can be displayed. Advertiser's can also make use of the system to enable information about products or services to be displayed to the golfer. Additional information of relevance can include a golfer's personal club selection criteria so that a particular club can be displayed associated with a particular yardage range. Warnings regarding dangerous conditions such as crossroads, cliffs, protected plant species, or sensitive course areas can also be displayed.

The golfer information system according to this invention can also include an internal dock so that time related information can be displayed. The time signal may also be generated from a GPS signal. This time information can be used to display target time to play against actual progress and displayed to a golfer and/or management staff information regarding speed of play.

A significant feature of the golfer information according to this invention is its "hands-free" operation. In order for the system to be truly "passive" a number of operational features are provided. For example, the system must be able to discriminate which hole is being played so that it will provide the appropriate landmark information and make calculations as to yardage. It is a well known tendency of many golfers to play a hole in an untraditional manner, sometimes hitting the ball from adjacent hole fairways, etc. In order for the system to avoid confusion by such play, various features are provided. The system can be triggered to make a distance calculation on some que such as the stopping of a golf cart. An input indicating such stoppage can come from a movement detector on the vehicle such as a rotary shaft encoder on a drive wheel or another drive train component. Alternatively, if the system receives satellite data indicating that it has not moved in a preselected time an assumption can be made that the unit has stopped. Upon stoppage, the appropriate yardage information is calculated and output.

The golf tee boxes of holes can be described as falling within certain coordinate boundaries. Upon the stoppage of a golf cart the system of this invention could determine if it falls within one of these boundaries. If so, the system identifies the hole being played and all yardage information calculated is related to that hole until it reaches a next hole tee which re-initializes the system for that hole. This system would accordingly allow holes to be played in a nonconsecutive manner. The system of this invention also allows the information provided to the golfer to change depending on their position on a particular golf hole. For example, the distance from the tee which indicates a drive distance is only significant in an area of a typical first shot landing. Thereafter, this information is meaningless. Similarly, hazards such as sandtraps may only be significant once the golfer approaches the green or is at some other area. Moreover, the golfer is generally unconcerned with hazards which are farther from the green than their present location. Thus, the system incorporates assumptions and operational features which allows pertinent information to be displayed without interaction with the golfer. As one means of providing pertinent information, a single golf hole can be divided into a number of zones defined by area boundaries. The system includes features for associating particular landmarks of interest with various zones. The boundaries of certain zones may also be based on a calculation from present position to center of the green with various distance ranges being associated with different zones. Thus, in this manner, zones need not necessarily be defined as area boundaries but rather ranges of distance from a landmark.

In addition to providing valuable information to the golfer, the system of this invention also includes features for enabling information to be transmitted to a central station such as a clubhouse where golf course operators can monitor play. The system can provide periodic information on the location of all golf carts on the golf course. This would enable convenient monitoring of speed of play and relative positioning of players on a hole. It would also provide a warning of golf carts being in forbidden areas. This system could also permit the golfer's to know where adjacent golf carts are located. For example, in some golf courses it is very difficult for a golfer on a tee or other location on a fairway to know if the golfer's in front of them are out of danger from their next shot. The transmitting capability of the golfer information system would also allow other maintenance information such as electric cart battery voltage or a condition where a golf cart remains in one position for an excessive period of time indicating a possible mechanical breakdown requiting attention. The golf course operator would also be able to monitor any incidences of a golf cart being in a forbidden area, such as too close to a green or other restricted areas. Information received by the central station could be relayed to a ranger who is roving on the course to enable them to pinpoint problem situations.

In addition to these features additional provisions for the system of this invention can include integration of the golfer information system with a course irrigation system so that irrigation is terminated when a golfer is in a particular area but is activated when it will not interfere with golf play. All the information available to the golfer and local course operator can also be communicated through remote link-up many miles away to allow monitoring of tournaments, coordinating television coverage, etc. Communication with the central station could also include a manual interface in which a golfer could send a signal such as a distress signal to the course operator.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
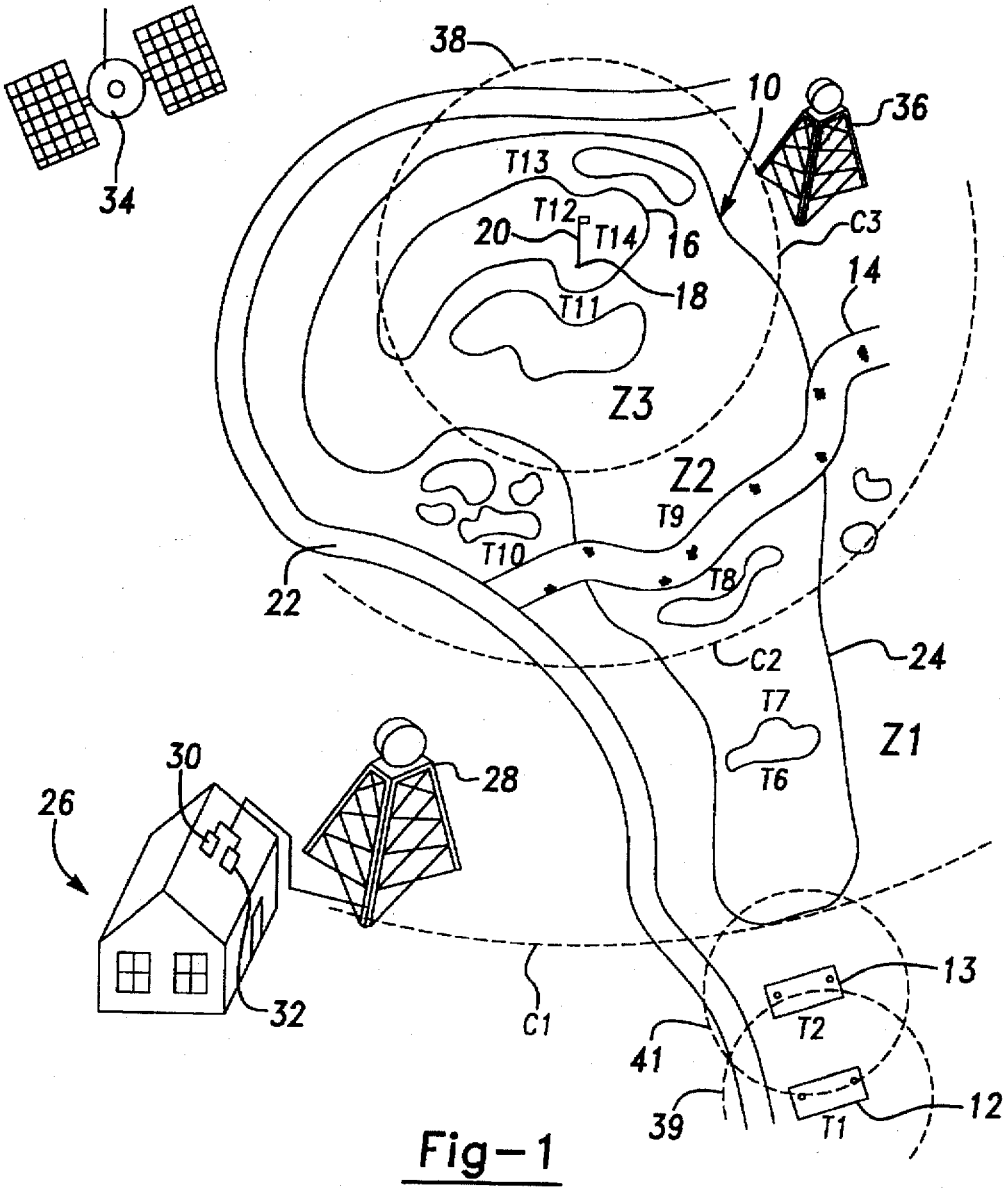
FIG. 1 is a plan view of an illustrative golf course hole incorporating elements of the golf information system according to a first embodiment of this invention.

With reference to FIG. 1, a representative golf course hole generally designated by reference numeral 10 is shown with a pair of tee areas 12 and 13, creek 14, and a green 16 having a cup 18 which supports a flag or pin 20. A designated golf cart path 22 is provided on the left-hand side of a fairway 24 on which a golf cart preferably travels while a golfer plays a round of golf. A clubhouse 26 is further provided with a transmitting and receiving antenna which is connected with a radio frequency receiver unit 30 and a radio frequency transmitter unit 32. Furthermore, a high altitude satellite 34 is also shown in FIG. 1, which is in geosynchronous earth orbit, wherein a global positioning satellite receiver receives signals from a number of such satellites to determine its location on the earth. Likewise, a radio frequency transmitting antenna 36, preferably a land-sea radio navigation antenna as run by the Coast Guard branch of the United States Government, is shown for transmitting signals to a radio navigation receiver, in this case a differential beacon receiver, in order to calculate positional error produced by a global positioning satellite receiver in order to obtain extremely accurate error correction which leads to accurate position from the DGPS system. An end-of-play region 38 is provided around a portion of the golf cart path 22 adjacent flag 20 such that presence of the golf cart within the region is used to determine end of play for a golf course hole which enhances a golf information system's ability to detect the presence of a particular golf cart within the golf course hole presently being played, even when play leads the golf cart into an adjacent hole as a result of a poorly played ball.

Each hole on the golf course is subdivided into regions, or zones via a zone look-up table. For example, hole 10 is subdivided into zones Z1–Z3. Key features, or landmarks of interest when playing from within each of these zones are then assigned, or mapped into each respective zone via individual landmark look-up tables. Typical landmarks are shown as a bunker T6, a stream T8 crossing a fairway, a position to clear the stream T9, center of green T12, and position of cup T14. As depicted in FIG. 1, zone Z1 is defined by a pair of circular regions C1 and C2 formed about a center-of-green (COG) of green 16. The center-of-green is depicted as landmark T12. Zone Z2 is defined by a pair of circular regions C2 and C3 formed about the COG of green 16. Finally, zone Z3 is defined by a single circular region C3 about the COG of green 16. Alternatively, various mapped geometries could be assigned to each region by providing a defined map region in memory, or integrally within a digital course map 86.

Preferably, the zones Z1–Z3 are strategically laid out on a hole 10 so as to encompass strategic locations on the hole suitable for conveying appropriate landmark information contained therein. For example, zone Z1 is laid out to include the region into which a golf ball is most likely to land when originally hit from the tee location 12. Therefore, one of the pieces of information assigned to a look-up table for zone Z1 would be "distance from the tee". Similarly, zone Z2 is laid out to include landmarks T8–T10 that are most likely encountered when playing a golf ball located within zone Z1. Finally, zone T3 is laid out so as to convey information for landmarks T11–T14 consisting of hazards and green information located approximate the cup and green.

Preferably, all landmarks T1–T14 located within zones Z1, Z2, and Z3 are assigned to zone Z1. Likewise, all landmarks T6–T14 located within zones Z2 and Z3 are assigned to zone Z2. Furthermore, all landmarks T8–T14 located within zone Z3 are assigned to zone Z3. Additionally, the COG (T12) and cup position T14 are both assigned to all zones of hole 10. Preferably, the landmark assignments for each zone Z1–Z3 are implemented in a landmark look-up-table 88 for each zone, stored in memory in EEPROM 98 and/or RAMS 100 and 102. For example, a look-up-table for landmarks assigned to hole 10, zone Z1 will list each landmark, or target T1–T14 along with an assigned x and y coordinate value locating the landmark with respect to the tee 12 on hole 10. As an example, the following landmark look-up-table lists target coordinates for landmarks assigned to zone Z1:

| Landmark (Target) No. | X Coord. | Y Coord. |
|---|---|---|
| T1 | 112 | 541 |
| T2 | 125 | 560 |
| . | . | . |

-continued

| Landmark (Target) No. | X Coord. | Y Coord. |
|---|---|---|
| . | . | . |
| . | . | . |
| T8 | 245 | 642 |
| T9 | 248 | 650 |
| T10 | 250 | 780 |
| T11 | 261 | 764 |
| T12 | 265 | 800 |
| T13 | 272 | 805 |
| T14 | 266 | 798 |

By subdividing each hole into zones and assigning landmarks of interest to a golfer playing from that zone, DGPS system 42 can passively calculate and display important landmarks T1–T14 and their distances from the present location of the golf ball on the hole 10. Each time the golf cart 40 stops on the hole, the DGPS system 42 is triggered to calculate the cart position (which is preferably adjacent the golf ball in play), determine the zone the cart is in via the zone look-up-table, and pull from the landmark look-up-tables the landmarks of interest for that particular zone along with their previously measured locations on the hole. Subsequently, the position of the cart is compared and calculated to each landmark position, and the distance to each landmark from the cart is visually displayed to the golfer on a display 104.

Preferably, additional information in the form of messages and advertisements can be displayed to the golfer. A typical message might screen-display the following header message, "Par 4 Hole 1 Hdcp 12" followed by tee ID, "Yardages are measured from WHITE buried marker" followed by target info for T6, "To bunker on right 156" T7, "To carry bunker 170" T8 "To stream crossing fairway 260" T9 "To carry stream 271" T12 "Overall length of hole 410" and possibly "USGA target time to play this hole is 14 min.". Alternatively, some or all of the information could be verbally broadcast to the golfer via a speaker and voice generation software resident in status board 52 as shown in FIG. 2.

A description of the physical components and electronic systems of a golf information system according to the first embodiment of this invention will be made with reference to FIGS. 2–6. A description of the operation of the system will be provided following the physical description of the elements. FIG. 2 shows a golf cart 40 that carries a differential global positioning system (DGPS) receiver 42 for detecting golf cart position on a course. DGPS receiver 42 principally comprises a GPS receiver 44 and a differential beacon receiver 46 which are interconnected such that GPS receiver 44 receives a satellite fix from a satellite and differential beacon receiver 46 receives radio and navigation signals to determine position relative to at least one transmitting antenna such that the differential error for the GPS receiver is calculated and corrected for in order to provide increased fix accuracy of a golf cart's position on a course. Both a GPS receiver 44 and compatible coupling differential beacon receiver 46 are commercially readily available which communicate together to perform enhanced fix accuracy as a DGPS receiver 42. Such systems are presently available from GARMIN INTERNATIONAL INC., located at 9875 Widmer Road, Lenexa Kans.

Figure 4:
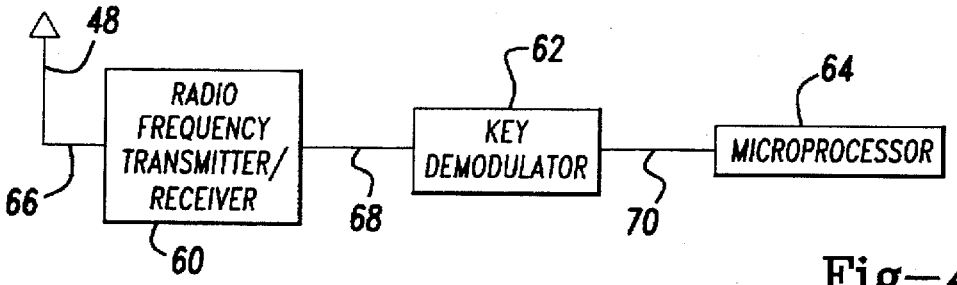
FIG. 4 is a block diagram of a radio frequency transmitter/receiver unit used upon the golf cart of the preferred embodiment of this invention for communicating with a clubhouse.

As shown in FIG. 4, a differential GPS system is incorporated in the antenna system on the golf cart 40. Alternatively, where the United States Government has waived the intentional degradation of non-military GPS signal accuracy on behalf of the Department of Defense, thus eliminating selective availability, differential GPS is no longer needed, and a standard GPS receiver 44 would provide the requisite necessary additional information of a golf cart accurately positioned on a golf course.

Figure 2:
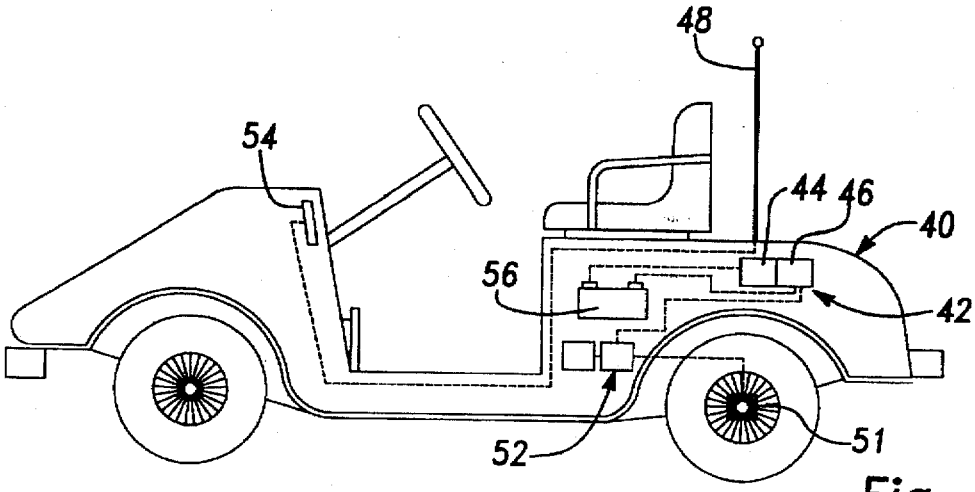
FIG. 2 is a schematic diagram of a golf cart incorporating elements of the golf information system in accordance with the first embodiment of this invention and showing a global positioning satellite receiver and a differential beacon receiver in relation to the golf cart.

With reference to FIG. 2, a golf cart 40 is provided with the DGPS receiver 42 in order to determine a golf cart's position. An antenna assembly 48 interconnects with the DGPS receiver 42 through a status board 52 which receives and stores additional information from the DGPS receiver 42, and furthermore provides display information to a computer and display board 54. A battery 56 drives the entire system electronics through the status board 52. Additionally, a wheel motion sensor 51 detects motion of the golf cart 40 on a course in order to detect when the cart stops so as to trigger the DGPS system to calculate a new position on the course, and passively display calculated distance information and messages to a golfer relating to a presently occupied hole and zone.

Figure 3:
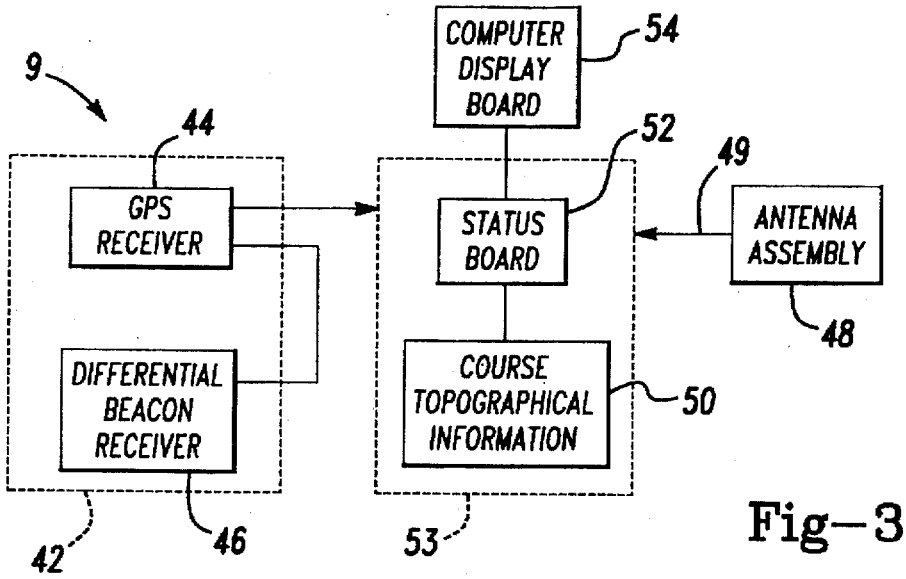
FIG. 3 is an electrical schematic diagram showing the functional subsystems of the global positioning satellite receiver and differential beacon receiver used with the golf cart information system of the first embodiment of this invention, and carried by a golf cart.

FIG. 3 further depicts the various elements of the golf cart information system 9. DGPS receiver 42 records positional information of the golf cart 40 which is input into status board 52. The calculated position of the cart can also be compared with known course position information stored on a digital course map 86 (optional) which is digitally stored to determine the status of a golf cart on a course. Preferably, this information is relayed to the clubhouse 26 via a communication system. Furthermore, the calculated position, along with any messages or updates received from the clubhouse, are fed to the computer and the display board 54 via the communication system such that position and status information, as well as messages and prompt signals, can be detected by a golfer on the cart. Preferably, a radio frequency transmitter/receiver unit 58 provides the communication system for interactive monitoring of a golf cart's position on a course by personnel at clubhouse 26 through the transmitting and receiving antenna 28.

Referring now to FIG. 4, there is shown details of the radio frequency transmitter/receiver unit 58 used in the preferred embodiment of this invention and containing the antenna 48 provided on the golf cart 40, a radio frequency transmitter and receiver 60, a key demodulator 62, and a micro-processor 64 (shown generally in FIG. 6 described below). Antenna 48 is coupled to the radio frequency transmitter/receiver 60 by bus 66 while the radio frequency transmitter/receiver 60 is coupled to the key demodulator 62 by bus 68. The output of the key demodulator 62 is coupled to the micro-processor 64 by bus 70.

In operation, signals are output from antenna 28 at the clubhouse 26 which are received by antenna 48 and then input to the radio frequency transmitter and receiver 60 by signals on bus 66. Thereafter, the received radio frequency signals are input into the key demodulator 62 by bus 68, where the received signal is demodulated thereby producing the original stream of data originally transmitted from the radio frequency transmitting unit 32 within the clubhouse 26. Demodulator 62 then impresses this data upon the bus 70 to the micro-processor 64. Micro-processor 64 then functions in conjunction with a micro-controller 72 and entities 82, 84, 98, 100, and 102, shown in FIGS. 6 and 7 in the aforementioned manner to receive and interpret the digital signal data originally received from the clubhouse antenna 28.

Figure 5:
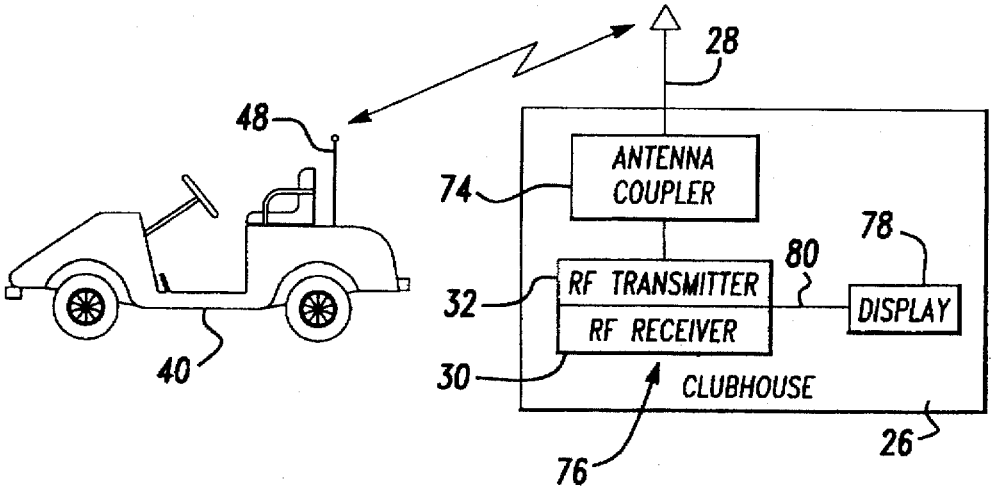
FIG. 5 is a block diagram of a radio frequency transmitter/receiver unit provided in a clubhouse for communicating with a golf cart.

Referring now to FIG. 5, there is shown a golf cart 40 in conjunction with a typical golf course clubhouse 26, in which a radio frequency transmitter/receiver unit 76 and a typical display (e.g., cathode ray tube, liquid crystal display, etc.) 78 are housed. Specifically, radio frequency transmitter/receiver 76 is coupled to antenna 28 by an antenna coupler 74 and is further coupled to display 78 by bus 80. In operation, the digital signature upon bus 49 which is stored on status board 52 as received from DGPS 44 and compared with landmark position data on look-up-tables 88 is sent by antenna 48 of golf cart 40 to antenna 28 which couples to receiver 32 within transmitter and receiver unit 76 which then places it upon bus 80 to the display 78. The receiver 32 would normally contain a key demodulator 62 as shown in FIG. 4 in order to reproduce this signature data from the radio frequency data. In this embodiment, the digital signature generator generates a golf cart signature in addition to the aforementioned distance signature upon status board 52 from DGPS 42 as well as current time data. Display 78 then visually displays the golf cart position information for golf cart 40 and the calculated distances to landmarks T1–T14. Detection of the cart within the regions 38, 39 and 41 indicates the hole presently being played by golfers on the cart in conjunction with the DGPS 42. In this way, the management of the typical golf course can determine where each of a plurality of golf carts 40 are located at any given time on the golf course and can, by observing the display 78 over a period of time, determine the approximate speed of play associated with users of golf cart 40. This could be used to potentially speed up the overall play upon a typical golf course. Furthermore, messages may also be transmitted to the golf cart 40 on a golf cart liquid crystal display 104 by micro-controller 72 if too much time has elapsed during play of a single golf hole 10. Furthermore, information can be transmitted to the display 104 indicating warnings or hazardous weather conditions, for example, lightning or tornados, as well as advertising, and requests for the user to transmit acknowledgement of receipt of such a message.

Additionally, wheel sensor 51 detects rotation and non-rotation of a golf cart wheel in response to motion and stopping conditions. When the sensor detects a stopping condition, software resident on status board 52 directs the DGPS 42 to calculate cart position on the course. Preferably, when sensor 51 detects cart motion, time information is displayed on display 104, along with any messages or advertisements. Each time the cart stops, a signal from sensor 51 directs a calculation of cart position, afterwhich the zone occupied by the cart is determined. Subsequently, the landmark look-up table associated with the zone is retrieved and the distance to each respective landmark referenced in the zone look-up-table is calculated and displayed.

Figure 6:
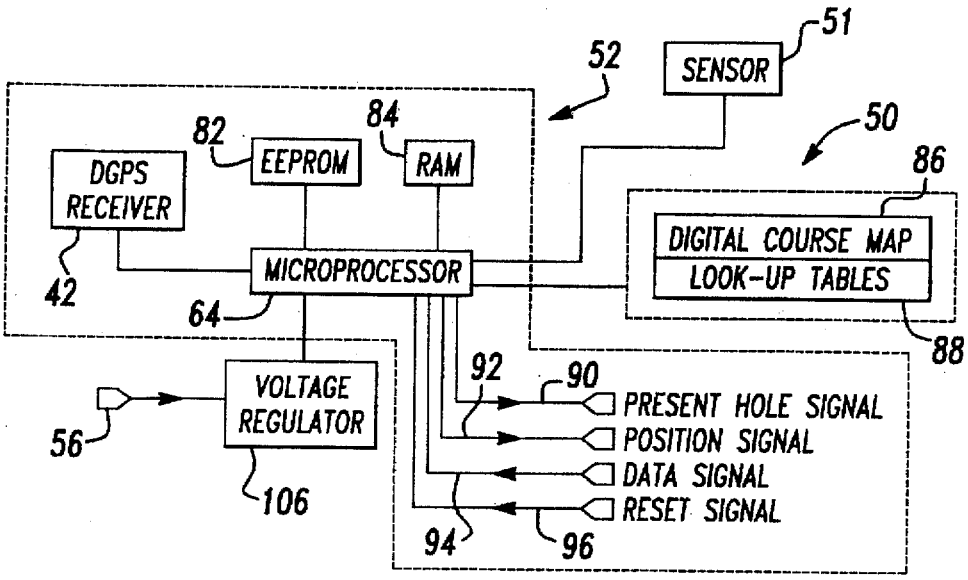
FIG. 6 is an electrical schematic diagram of the status board and zone landmark look-up tables found generally in FIG. 2.

The status board 52 and course topographical information 50 are shown in detail in FIG. 6 and include micro-processor 64 having its operating system software stored on EEPROM 82 and RAM 84. Course topographical information 50 consists of a digital course map 86 and all of the previously mentioned look-up tables 88. The look-up tables include look-up tables for each of zones Z1–Z3, as well as look-up tables relating to detection of presence on a particular hole on the course; namely, tables that detect entrance onto a particular hole via regions 39 and 41, as well as exit via region 38. Micro-processor 64 monitors and receives position information from DGPS 42. A voltage regulator 106 receives power from golf cart battery 56 and provides a filtered and controlled power supply for reading position information from the DGPS 42. As shown in FIG. 5, a number of data input and output signal lines are provided for micro-processor 64, including present hole signal 90 and position signal 92 which are outputted from micro-processor 64, and receive data signal 94 and reset signal 96 which are inputs. Operation of the DGPS 42 in response to signals from lines 90–96 will be described in greater detail below.

Figure 7:
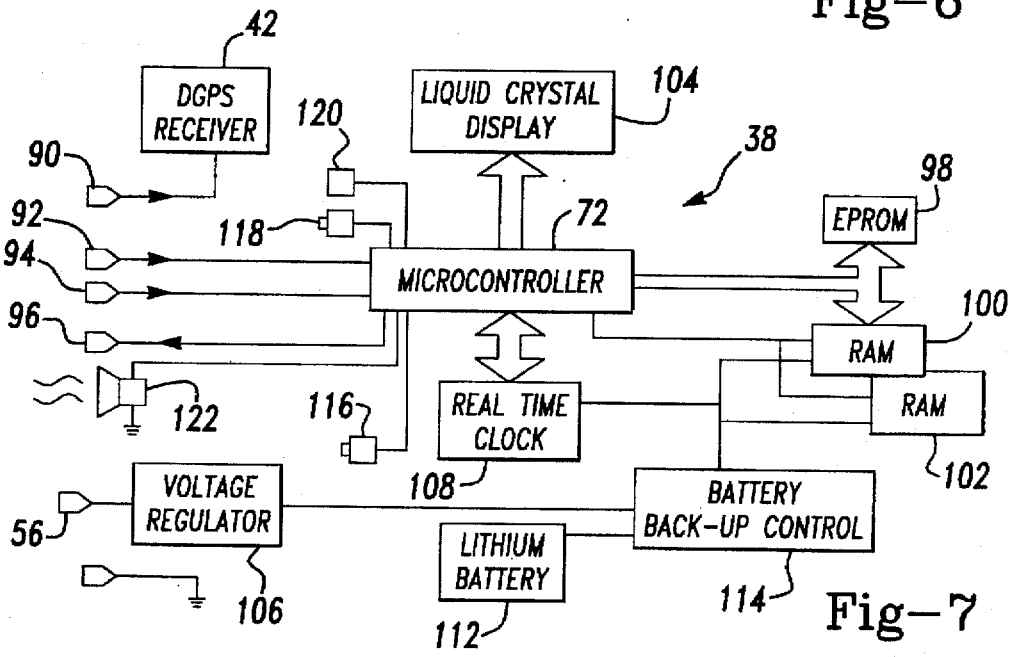
FIG. 7 is an electrical schematic diagram of the functional subsystems of the status board shown generally in FIGS. 2 and 3.

The functional components and subsystems of the computer and display board 54 are shown with reference to FIG. 7. Micro-controller 72 has its operating system stored on EEPROM 98 and several RAM chips 100 and 102 are provided for data storage. A real time clock 108 provides a time-of-day reference and can be used for displaying a local time message to the golfer and/or timing the golfer's progress through the course. The power supply for computer and display board 54 is the golf cart battery 56 and also includes a voltage regulator 110. Lithium battery 112 and battery backup control 114 are provided to retain stored information upon interruption of power from golf cart battery 56. Micro-controller 72 drives display 104 which is preferably a liquid crystal-type since they are easily read in bright sunlight. The position transmit and receive signals 92 and 94 are inputted into micro-controller 72, and reset signal 96 is outputted. The present hole signal 90 is provided for a ranger of a clubhouse to determine the present hole being played by golfers on a specific identified golf cart.

Normally, signal 90 is operable to receive update signals which modify the parameters defining the start and end-of-play regions for a particular hole 10. A tee check region 39 or 41 indicates start-of-play on hole 10, either from tee 12 or 13, respectively, as the DGPS enters the region along cart path 22 and stops. Similarly, an end of play region 38 indicates end-of-play for hole 10 as the cart enters the region about green 16 and stops. A change in status of the present hole being played by a golfer on cart 40 can be tracked by detection of the cart within the tee check and end-of-play regions for each hole on the course. Preferably, each region is a circle having a defined radius, which is identified by a specific position point on the course stored in memory in an initial tee-check look-up-table 88 such that it is compared by micro-processor 64 with a DGPS position point for the cart 40. For example, region 38 can be provided about a hole 10 such that positioning of a cart adjacent a hole indicates end of play of that hole and the system is notified once the cart leaves the region to update the hole status incrementally to the next numerical hole number such that the present hole signal 90 is incrementally increased by unit one. Alternatively or additionally, a tee-check region 39 or 41 can be provided about a tee area 12 or 13, respectively, such that position of the cart adjacent the tee can be used to trigger start of a new hole, and once detected, the number of a hole being played can be "reset".

In one mode of operation, received data signal 94 is provided to receive updated landmark and course change information as contained within digital course map 86 and/or look-up tables 88. Normally, signal 94 is in an activated and ready state and only sends a signal to micro-processor 64 when a cup position on a course, or a desired landmark position has been changed by a course grounds keeper. The transmitted present cup signal 90 consists of the coded signal outputted from the DGPS 42 which has been processed and reformatted by a micro-processor 64.

Operation of the golf information system according to the first embodiment of this invention will now be described in view of the above description. Since the high altitude satellite 34 and radio frequency transmitting antenna 36 are continuously operating, an accurate position of cart 40 is outputted to status board 52 as further detailed in FIG. 6. Preferably, due to the implementation of Selective Ability (SA) which degrades the accuracy of the satellite signal, DGPS 42 must be implemented in order to accurately obtain the cart's position. Alternatively, in the event selective availability is not implemented on the global positioning satellite signal, a standard GPS unit 44 can be utilized alone to obtain an accurate position of the golf cart 40 on a golf course. Furthermore, ordinary GPS can be implemented which will provide less accurate positional information. Micro-processor 64 receives such accurate position information continuously updating such information so as to calculate the distance to landmarks retrieved from the look-up tables 88, or to compare it with a digital course map 86 in conjunction with information on the course hole presently being played as detected by the DGPS 42 in order to provide information both to the golf cart operator via display 54, namely, liquid crystal display 104, as well as by a golf cart operator via receiving unit 30 in a clubhouse 26 on a clubhouse display 78. The software on the status board 52 compares the position information from the DGPS 42, or GPS (44), with the digital course map information in order to provide a golf cart position with respect to a particular hole, namely, in relation to a green and hole, or a tee area 12. Such information provides relative positional information of the golf cart with respect to the golf course. Alternatively, global position of a golf cart with respect to the earth can be compared to positional information of the golf course in determining position of a golf cart on a golf course. Furthermore, speed of a golf cart on a golf course can be monitored and detected by differentially measuring and comparing the position information from the DGPS 42 over time, or alternatively, by monitoring velocity information output from a DGPS 42 which displays golf cart speed.

The signal outputted by the DGPS 42 is processed at micro-processor 66 and transmitted to micro-controller 72 which fetches a set of instructions from a look-up table contained in processor EEPROM 98 and/or RAM's 100 and 102. The signal from micro-processor 64 on line 92 is sent to micro-controller 72 in serial fashion, for example, as a twelve-bit word at 1,200 baud. Signals having larger binary digits, or words, could be used to discriminate larger chunks of data received from the DGPS.

Figure 8:
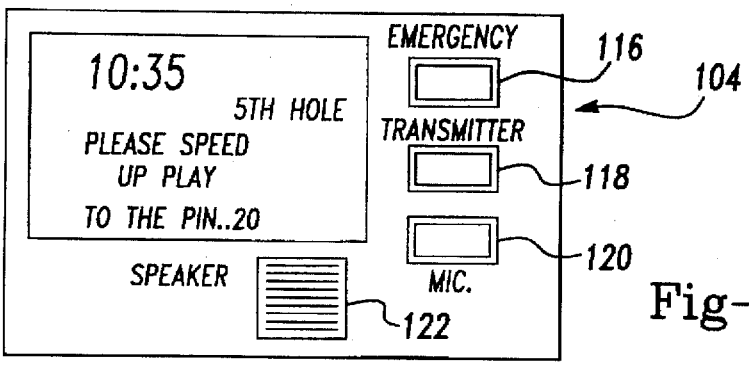
FIG. 8 presents an illustrative output of information for the golfer provided by the first embodiment of the system of FIG. 2.

FIG. 8 illustrates a representative hands-free output generated by a clubhouse transmitted message which informs a golf cart operator of a slow play condition, as well as displays present time, and position on a course when present in zone 23, as well as present hole being played. Furthermore, distance to the pin is also displayed in a manner which could be utilized to further provide positional information of a golf cart on a course to a golfer. Likewise, time and time remaining to play can be displayed when motion sensor 51 detects movement of the cart between locations on the course. An emergency prompt button 116 is also provided adjacent the liquid crystal display 104 in the computer and display board 54 which allows a golfer to signal an emergency on the course to a golf course employee in clubhouse 26. For example, a medical emergency requiring immediate action could be signaled by depressing the emergency button where an operator in the clubhouse can detect the golf cart's present position and can dispatch a course ranger immediately to respond to such emergency. Furthermore, a transmit button 118, or alternatively, a dual use of button 116, can be used to signal an acknowledgement of a message received from a clubhouse by a golfer on the golf cart 40. For example, upon transmission of a message to speed up play, a golfer can acknowledge receipt by depressing the transmit button 118. Furthermore, a microphone 120 and speaker 122 are further provided on the display board 54 for carrying out a conversation between the clubhouse and golf cart.

By using a digital course map 86 in conjunction with the DGPS position information to track motion of a cart on the course, the size of memory necessary for a ranger to monitor a golf cart's position is minimized, and the reliability and speed of information transmission between the golf cart and clubhouse is enhanced, and modifications to the outputted information can be easily achieved by reprogramming out the digital course map 86, or else by using the landmark positions or regions resident in look-up tables 88. Digital course map systems, or cartographic map systems, are presently available for marine use from GARMIN INTERNATIONAL INC., located at 9875 Widmer Road, Lenexa, Kans. An example is the GPSMAP 220 by GARMIN which utilizes a GPS receiver with cartographic digitized maps, or charts, from Navionics located at 8 Pine Meadow Pl., Commack, N.Y. Alteratively, either the digital course map 86 and/or the landmark lock-up tables 88 can be provided in the clubhouse such that precise positional information is transmitted from the golf cart through antenna 48 to the clubhouse antenna 28 where the information is compared with the digital course map information and landmarks to determine a golf carts position on the course, as well as a golf carts relative position to known landmarks or features on the course which further allows for protection of the present hole being played by a golfer on the cart.

In addition to the above features, the golf information system according to this first embodiment also provides the capability of several additional functions and features. In conjunction with the real time clock 108 as well as the landmark look-up tables 88, micro-controller 72 can measure the elapsed time a golf cart has spent on a particular hole or has spent throughout a golf course such that the time of play for a particular hole or a segment of the course can be monitored. If the measured play is excessively slow, a prompting message can be automatically displayed to a golfer on display board 54 which may be further supplemented by an audible signal from an emitter, here speaker 122. The look-up table contained in EEPROM 98 and RAM's 100 and 102 for micro-controller 72 can also include advertising messages which are activated by an operator or system in the clubhouse. The system can also contain a number of housekeeping functions. For example, an internal count can be made of the number of reading cycles by a particular golf cart to evaluate cart usage and a low battery signal could be outputted from the cart which alerts the operator of the necessity of maintaining the cart. Likewise, the number of warning signals displayed to a golf cart operator can be monitored both by the golf cart operator on display board 54 and display 78 in the clubhouse.

Another refinement for the subject golf information system, of this first embodiment, comprehends changes in repositioning a cup 18 on the surface of a green 16 which has the effect of changing the distance from the reference points provided in the digital course map 86. As shown in FIG. 1, a starting location for a given hole can be designated with the landmark x,y coordinate found in the look-up tables 88, the end-of-play region 38 as well as, or alternatively by, the tee check regions 39 or 41. Preferably, both regions are positioned adjacent the tee area 12 and green 16, or hole 10, in the location where a golf cart 40 will pass as a player begins or ends play on a particular hole. For example, the size of the region surrounding a definitive location or region on the course is preprogrammed and determined based upon course and hole shape, size and ground surface area provided for a golf course to pass over. Furthermore, zones Z1–Z3 are actually regions defined by circles formed about COG, each having a different radius. Such information is stored in EEPROM in the look-up tables 88 adjacent EEPROM stored information for digital course map 86. When the golf cart 40 is detected through DGPS 42 in response to motion sensor to be within such a region, knowledge about the location of the cart with respect to a hole is made available. For example, when a golf cart is detected in the tee check 39 or 41 via matching with a tee check look-up-table, it is known that the golf cart is beginning play on that particular hole. Likewise, as a golf cart enters the end-of-play region 38, it is known that the golf cart is completing play on that hole and about to begin play on the next, or subsequent hole. Preferably, the digital course map 86 can be updated from an operator within the clubhouse through transmitting unit 32 and data landmark signal 94 with reset signal 96. In the case where a cup is moved slightly, the digital course map can be updated to account for a change in relative position between the COG and the cup. Furthermore, in the case where positional information is displayed on display board 54 to a golfer which indicates distance to a green and hole, the respective distances and positions to landmarks on the course can be updated to display to a golfer, for example, the distances to each landmark, as well as the cup (or COG).

It is to be understood that the invention is not limited to the exact construction illustrated and described above, but that various changes and modifications may be made without departing from the spirit and scope of the invention as defined in the following claims.

I claim:

1. A golf information system for providing a golfer with information regarding the position and distance of designated features on a golf course having a plurality of golf holes comprising:

golfer locating means which moves with the golfer for receiving signals and generating a golfer location signal which locates the golfer on the golf course, and location interpreting and comparing means which moves with the golfer for interpreting said golfer location signal via a memory, said memory constructed and arranged for storing coordinate data of landmarks comprising topographical features of the golf course, and including means for designating a plurality of zones for one or more of each of the golf holes on the golf course, and relating specific subsets of said landmark coordinate data to each of said zones and comparing a difference in position of said golfer location signal to one or more of said landmark coordinate data assigned to one of said zones on the golf course where the golfer is located, said location interpreting and comparing means relaying said difference in position as a distance between said landmarks associated with said zone and said golfer locating means to output means for outputting said information to the golfer, and said location interpreting and comparing means passively providing said information to said golfer without golfer input, each of the plurality of holes on the golf course divided into a plurality of said zones, each of said zones including at least one memory stored landmark location mapped to said zone and retrievable from memory in response to detection of one of said golfer location signals present within said zone, and means for detecting a stopped condition of the system, wherein the system automatically calculates said golfer location signal in response to said detected stopped condition, presence in one of said zones is determined via retrieval from memory, landmarks assigned to said zone are recalled from memory along with landmark coordinate data, and distances are calculated between each of said retrieved landmarks and said golfer location signal.

2. The golf information system of claim 1 wherein said stopped condition is detected by a sensor on a golf cart or by global positioning satellite technology.

3. The golf information system of claim 1 wherein the system automatically outputs personal club selection suggestion based on golfers personal input into a memory file.

4. A method for determining the position of a golf ball relative to known locations on a golf course using a GPS system comprising the steps of:

locating the positions of a plurality of landmarks on the golf course;

defining a plurality of regions on the golf course, each of said regions mapped in relationship to a green having a cup on the golf course;

mapping at least one of said landmarks to one of said regions;

storing in memory the definitions of each of the regions in combination with region mapping information;

storing the position of the green in memory;

positioning a remote GPS receiver near the golf ball on the golf course;

determining the position of the remote receiver using the GPS system;

determining the region in which the golf ball is located on the course from such position wherein said mapping region information pertaining to a particular hole are automatically retrieved upon the remote receiver's presence in a certain region;

recalling such landmarks present in such golf ball region;

determining the distance from the remote receiver to such landmarks using previously stored landmark position information, such mapping region information, and the position of the GPS receiver; and displaying distances from the remote receiver to the cup and landmarks mapped with such region.

5. A method of claim 4 wherein said landmarks are mapped into memory from a digitized aerial photograph calibrated by geodetic survey techniques creating a digital data base.

6. The method of claim 5 wherein further landmark locations are taken from an x,y coordinate grid of said digital data base.

7. A golf information system for providing a golfer with information regarding the position and distance of designated features on a golf course having a plurality of golf holes comprising:

golfer locating means which moves with the golfer for receiving signals and generating a golfer location signal which locates the golfer on the golf course; and location interpreting and comparing means which moves with the golfer for interpreting said golfer locating signal via a memory, said memory constructed and arranged for storing coordinate data of landmarks comprising topographical features of the golf course, and including means for designating a plurality of zones on the golf course, and relating specific subsets of said landmark coordinate data to each of said zones and comparing a difference in position of said golfer location signal to one or more of said landmark coordinate data assigned to one of said zones for one or more of each of the golf holes on the golf course where the golfer is located, said location interpreting and comparing means relaying said difference in position as a distance between said landmarks associated with said zone and said golfer locating means to output means for outputting said information to the golfer;

said location interpreting and comparing means passively providing said information to said golfer without golfer input;

wherein said output means is configured for outputting non-golf information to the golfer while said golfer locating means is in motion between stationary positions.

8. The golf information system of claim 7 wherein said non-golf information comprises product or service advertisements or endorsements.

9. The golf information system of claim 7 wherein said non-golf information is associated with at least one of said zones and said non-golf information is outputted only when the golfer is located within said at least one associated zone and said golf locating means is in motion between said stationary positions.

10. A golf information system for providing a golfer with information regarding the position and distance of designated features on a golf course having a plurality of golf holes comprising:

golfer locating means which moves with the golfer for receiving signals and generating a golfer location signal which locates the golfer on the golf course, location interpreting and comparing means which moves with the golfer for interpreting said golfer location signal via a memory, said memory constructed and arranged for storing coordinate data of landmarks comprising topographical features of the golf course, and including means for designating a plurality of zones for one or more of each of the golf holes on the golf course, and relating specific subsets of said landmark coordinate data to each of said zones and comparing a difference in position of said golfer location signal to one or more of said landmark coordinate data assigned to one of said zones on the golf course where the golfer is located, said location interpreting and comparing means relaying said difference in position as a distance between said landmarks associated with said zone and said golfer locating means to output means for outputting said information to the golfer, and said location interpreting and comparing means passively providing said information to said golfer without golfer input, and receiver means for receiving golf related information from a transmitting station wherein said received information comprises golf related information and further comprises golf tournament standings information.

11. A golf information system for providing a golfer with information regarding the position and distance of designated features on a golf course having a plurality of golf holes comprising:

golfer locating means which moves with the golfer for receiving signals and generating a golfer location signal which locates the golfer on the golf course, location interpreting and comparing means which moves with the golfer for interpreting said golfer location signal via a memory, said memory constructed and arranged for storing coordinate data of landmarks comprising topographical features of the golf course, and including means for designating a plurality of zones for one or more of each of the golf holes on the golf course, and relating specific subsets of said landmark coordinate data to each of said zones and comparing a difference in position of said golfer location signal to one or more of said landmark coordinate data assigned to one of said zones on the golf course where the golfer is located, said location interpreting and comparing means relaying said difference in position as a distance between said landmarks associated with said zone and said golfer locating means to output means for outputting said information to the golfer, and said location interpreting and comparing means passively providing said information to said golfer without golfer input, and receiver means for receiving information from a transmitting station wherein said received information comprises non-golf related information.

12. A golf information system of claim 11 wherein said non-golf related information comprises product or service advertisements or endorsements.

* * * * *

US005685786C1

(12) EX PARTE REEXAMINATION CERTIFICATE (8011th)

United States Patent
Dudley

(10) Number: US 5,685,786 C1
(45) Certificate Issued: Feb. 8, 2011

(54) PASSIVE GOLF INFORMATION SYSTEM AND METHOD

(75) Inventor: Douglas P. Dudley, West Bloomfield, MI (US)

(73) Assignee: Tulip Group Investments, Limited, Dubai, Jae (AE)

Reexamination Request:
No. 90/010,314, Oct. 13, 2008

Reexamination Certificate for:

| | |
|---|---|
| Patent No.: | **5,685,786** |
| Issued: | **Nov. 11, 1997** |
| Appl. No.: | **08/449,805** |
| Filed: | **May 24, 1995** |

Related U.S. Application Data

(63) Continuation-in-part of application No. 08/240,983, filed on May 11, 1994, now abandoned.

(51) Int. Cl.
*A63B 57/00* (2006.01)

(52) U.S. Cl. ..... 473/407; 340/323 R; 473/131; 473/409

(58) Field of Classification Search ..... None

See application file for complete search history.

(56) References Cited

U.S. PATENT DOCUMENTS

| | | | | |
|---|---|---|---|---|
| 4,837,700 | A | 6/1989 | Ando | 701/213 |
| 5,044,634 | A | 9/1991 | Dudley | 273/32 |
| 5,319,548 | A | 6/1994 | Germain | |
| 5,438,518 | A | 8/1995 | Bianco | 364/460 |
| 5,524,081 | A | 6/1996 | Paul | 364/460 |
| 6,062,991 | A | 5/2000 | Moriarty et al. | |

*Primary Examiner*—Roland G. Foster

(57) ABSTRACT

A golf information system and method which provides yardage and other information to a golfer relative to landmarks on a golf course operating in a "hands-free" or passive manner. In one embodiment, a differential global positioning satellite receiver (DGPS) is utilized to calculate a golf cart position and each time the cart stops, the detected position is compared with positions of landmarks mapped to zones on holes of the course. A location of each landmark is predetermined and stored in a look-up table, afterwhich the golf cart position is compared with the pre-stored positions to obtain a distance between the golf cart and each landmark. The calculated distance is subsequently outputted, preferably on a visual display where it is observed by a golfer. The system can also be used to send speed-of-play messages to a golfer from a clubhouse in order to speed up play, and can also be used to send emergency signals, and advertisements to the golfer. Information outputted to the golfer can be obtained from on-board memory, or in systems with communication features, the information can be sent from a golf course clubhouse or other remote location.

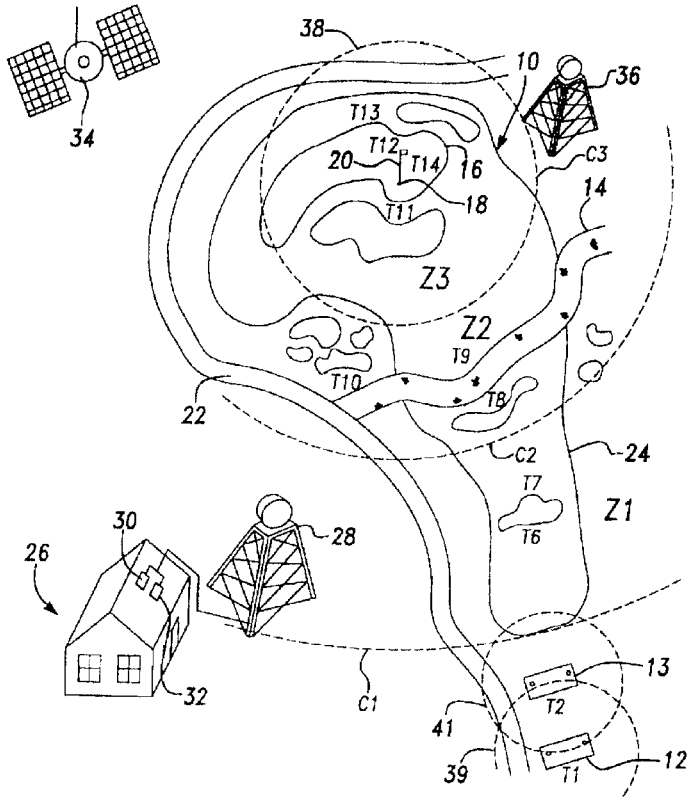

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-6 and 10 are cancelled.

Claims 7 and 11 are determined to be patentable as amended.

Claims 8, 9 and 12, dependent on an amended claim, are determined to be patentable.

7. A golf information system for providing a golfer with information regarding the position and distance of designated features on a golf course having a plurality of golf holes comprising:

golfer locating means which moves with the golfer for receiving signals and generating a golfer location signal which locates the golfer on the golf course; and location interpreting and comparing means which moves with the golfer for interpreting said golfer locating signal via a memory, said memory constructed and arranged for storing coordinate data of landmarks comprising topographical features of the golf course, and including means for designating a plurality of zones on the golf course, and relating specific subsets of said landmark coordinate data to each of said zones and comparing a difference in position of said golfer location signal to one or more of said landmark coordinate data assigned to one of said zones for one or more of each of the golf holes on the golf course where the golfer is located, said location interpreting and comparing means relaying said difference in position as a distance between said landmarks associated with said zone and said golfer locating means to output means for outputting said information to the golfer;

said location interpreting and comparing means passively providing said information to said golfer without golfer input;

wherein said output means [is configured for outputting] *outputs information comprising* non-golf information to the golfer while said golfer locating means is in motion between stationary positions.

11. A golf information system for providing a golfer with information regarding the position and distance of designated features on a golf course having a plurality of golf holes comprising:

golf locating means which moves with the golfer for receiving signals and generating a golfer location signal which locates the golfer on the golf course, location interpeting and comparing means which moves with the golfer for interpreting said golfer location signal via a memory, said memory constructed and arranged for storing coordinate data of landmarks comprising topographical features of the golf course, and including means for designating a plurality of zones for one or more of each of the golf holes on the golf course, and relating specific subsets of said landmark coordinate data to each of said zones and comparing a difference in position of said golfer location signal to one or more of said landmark coordinate data assigned to one of said zones on the golf course where the golfer is located, said location interpreting and comparing means relaying said difference in position as a distance between said landmarks associated with said zone and said golfer locating means to output means for outputting said information to the golfer, and said location interpreting and comparing means passively providing said information to said golfer without golfer input, and receiver means for receiving information from a transmitting station wherein said received information comprises non-golf related information *while said golfer locating means is in motion between stationary positions*.

* * * * *